US006354683B1

(12) United States Patent
Benbow

(10) Patent No.: US 6,354,683 B1
(45) Date of Patent: Mar. 12, 2002

(54) APPARATUS AND METHOD FOR ALIGNING AND SECURING A DRAWER SLIDE

(76) Inventor: Christopher B. Benbow, 1300 Vista Way, Red Bluff, CA (US) 96080

( * ) Notice: Subject to any disclaimer, the term of this patent is extended or adjusted under 35 U.S.C. 154(b) by 0 days.

(21) Appl. No.: 09/728,736

(22) Filed: Nov. 30, 2000

(51) Int. Cl.[7] ..... A47B 88/00; B25C 1/12; F16B 15/00

(52) U.S. Cl. ..... 312/334.7; 312/334.1; 227/10; 411/440

(58) Field of Search ..... 312/334.1, 334.7, 312/330.1, 334.16, 334.18, 348.1, 348.2; 227/9, 10, 107, 109, 120; 411/20, 440, 441, 439

(56) References Cited

U.S. PATENT DOCUMENTS

| | | | | | |
|---|---|---|---|---|---|
| 2,574,830 | A | | 11/1951 | Howell | 102/317 |
| 3,048,849 | A | * | 8/1962 | De Caro et al. | 411/440 X |
| 3,332,311 | A | * | 7/1967 | Schulz | 411/20 |
| 3,471,174 | A | | 10/1969 | Manning | 285/18 |
| 4,271,747 | A | * | 6/1981 | Bendler et al. | 411/440 X |
| 4,809,898 | A | | 3/1989 | Gassner et al. | 227/8 |
| 4,930,673 | A | | 6/1990 | Pfister | 227/10 |
| 4,932,580 | A | | 6/1990 | Pfister et al. | 227/10 |
| 5,116,175 | A | * | 5/1992 | Adini | 411/20 |
| 5,215,419 | A | | 6/1993 | Steinhilber | 411/440 |
| 5,497,929 | A | | 3/1996 | Armstrong | 227/9 |
| 5,601,350 | A | * | 2/1997 | Rock et al. | 312/334.1 |

* cited by examiner

*Primary Examiner*—James O. Hansen
(74) *Attorney, Agent, or Firm*—John P. O'Banion

(57) ABSTRACT

A slide fastening assembly and alignment system for mounting a drawer slide to the interior wall of a cabinet or piece of furniture. The fastener assembly includes a fastener cartridge having a body and interior chamber. The chamber encloses a small explosive charge, a detonator, a piston head and a sharpened shaft attached to the piston head. Encapsulated adhesive may optionally surround the shaft. In the preferred embodiment, the cartridge is mounted to a fastener plate that is fixed to the drawer slide member to be attached to the interior of the cabinet. In an alternative embodiment the cartridge is mounted to a bracket. In use, the drawer slide is mounted to the drawer and the drawer is then positioned in the interior of the cabinet. Once the drawer is vertically and horizontally aligned, the charge is detonated and the piston head and shaft secure the fastener plate to the wall of the cabinet through an aperture in the fastener plate or bracket. The fastener plate may additionally include pronged fastener arms that further secure the plate to the cabinet wall that may be hammered in place.

55 Claims, 15 Drawing Sheets

APPARATUS AND METHOD FOR ALIGNING AND SECURING A DRAWER SLIDE

BACKGROUND OF THE INVENTION

1. Field of the Invention

This invention pertains generally to linear member alignment and securing mechanisms, and more particularly to a drawer slide hardware alignment and mounting apparatus and method using a small explosive charge to drive a fastener to secure the slide in the desired position.

2. Description of the Background Art

There are a number of drawer slide assemblies known in the art that allow drawers and the like to smoothly slide from a closed position to an open position, and back again, as needed. The drawer slide assembly also serves to support the drawer within the cabinet and to properly orient the faceplate of the drawer with respect to the frame and other drawer faceplates when the drawer is in the closed position. Proper alignment of the drawer faces is essential to the general appearance of the drawer.

Generally, there are four types of linearly extending drawer slides known in the art: the European, the American, the full extension, and the centrally mounted single track. Each assembly typically has an interlinked track and rail that slide longitudinally with respect to each other. The rail is mounted to the body of the drawer, and the track is attached to the interior of the cabinet. The sliding action is normally facilitated by the presence of at least one wheel attached to the rail that engages the corresponding track. However, in full extension hardware, ball bearings rather than wheels facilitate the sliding action.

The European type of slide assembly includes a pair of elongate tracks affixed to the left and right side walls of the cabinet, and a pair of corresponding drawer rails mounted to the sides of the drawer. Typically, each drawer rail has at least one wheel which rotationally engages the track, and each track has one wheel that rotationally engages the rail. The drawer rails and the elongate tracks cooperate to support the drawer and allow the drawer to readily slide from a closed to an open position and back.

The American type of drawer slide assembly includes a pair of drawer rails mounted to the sides of the drawer and a pair of tracks mounted to the back wall of the cabinet rather than the sidewalls. Typically, the interior end of each track is held within a support bracket that is mounted to the back wall panel of the cabinet. The ends of the tracks opposite to the brackets are normally mounted to the face frame of the cabinet with screws.

Full extension slide hardware known in the art includes one or more slide embers of decreasing width that telescope linearly. Typically, the outermost slide member is mounted with screws to the sidewalls of the cabinet. The drawer is mounted to the innermost slide member.

The single-track type of slide assembly known in the art has a single track centrally mounted between the front frame and the back wall of the cabinet. A rear guide plate or wheel structure is mounted to the rear upright of the drawer and slides within the track. The track is typically held in a bracket, which is mounted to the back panel of the cabinet similar to the American type slide assembly.

To install any of these prior art slide assemblies, the installer usually loosely anchors the track to the cabinet frame at the front and rear ends of the track. Next, the drawer with the rails is placed into the cabinet, and the rails, track and faceplate are physically aligned. The screws in the tracks are carefully tightened further after the drawer is removed. This procedure may be repeated several times until the drawer face is properly aligned, and can be very time consuming and imprecise.

Proper alignment of each slide assembly within the cabinet is essential for a smooth inward and outward sliding action of the drawer. Misaligned drawer slides may not only cause the drawer to bind with use, but may also result in moving the drawer face out of position. The drawer face should be matched with the frame when the drawer is closed and should be horizontally and vertically aligned with the other drawer faces or doors of the cabinet. Misaligned slides may also cause the top or bottom side of the drawer face to tip away from the frame thereby forming a gap. In addition, one side of the drawer face may be lower than the other if the drawer slides are misaligned causing the cabinet to appear displeasing to the eye.

It is not always possible to accurately align the drawer slides at the time of manufacture of the cabinet. Normally, the drawer slides must be adjusted after the complete cabinet is installed. Such adjustments are necessary because the walls and floors at the building site may not be perfectly level or square. The body of the cabinet may be manipulated to accommodate the geometry of the building and that manipulation causes the slides to be out of alignment. Consequently, drawers that slid smoothly at the time of construction now bind and fail to fit properly in the cabinet.

A person repairing or remodeling the drawers or cabinet encounters similar problems. The repair of drawers with broken slides or the installation of replacement drawers requires the installation of new slides in an existing cabinet that has been permanently installed. It is often necessary to place and remove the drawer and adjust the slides several times before the drawer face fits flush with the frame and is horizontally and vertically aligned with the other drawer faces. Furthermore, the drawer slides are installed and aligned in a confined space that has narrow points of access to the interior of the cabinet. Proper positioning of the slide brackets can be difficult and time consuming, particularly if the slides are mounted to the back of the cabinet.

Accordingly, there is a need for a drawer slide assembly that can be easily aligned and anchored at the time of installation in a building, camper, mobile home or other location without the need for repositioning the rails and brackets. The present invention satisfies that need, as well as others, and generally overcomes the deficiencies found in existing equipment.

BRIEF SUMMARY OF THE INVENTION

The present invention is a drawer slide mounting apparatus and method for quickly and easily aligning and mounting the slide hardware in new or existing drawer cabinets. While the specific examples disclosed herein apply to cabinetry, it will be understood that the invention can also be applied wherever blind fasteners are needed or used.

By way of example, and not of limitation, the apparatus comprises a plurality of fastener assemblies that are mounted to a drawer slide. In the preferred embodiment, each fastener assembly has a fastener plate, a cartridge and a lanyard or other means of remotely activating the cartridge. The cartridge has a hollow, generally cylindrical body having a closed end forming a chamber. A small explosive charge is placed within the chamber at the closed end of the cylinder.

The invention also includes means for detonating the explosive charge. The preferred means for detonation is friction caused by pulling a lanyard that passes thorough a small hole in the body of the cartridge to the charge within the chamber.

A planar piston head is disposed within the chamber such that the explosive charge is between the piston head and the body of the cartridge forming the enclosure. The piston head, which is preferably planar, preferably has at least one pointed shaft fixed perpendicularly to the planar head on the surface opposite the surface facing the explosive charge. A thumbtack, known in the art, has been successfully used as the piston head-shaft combination.

The cartridge is positioned over an aperture in the fastener plate such that the pointed shaft is aligned over the aperture prior to detonation of the charge. The exterior of the cartridge body preferably has a circumferential groove that receives a pair of tabs from the fastener plate, which positions and secures the cartridge to the plate. In the preferred embodiment of the cartridge body, the circumferential groove is slightly tapered from the top of the groove to the bottom. Additionally, the body wall is preferably very thin at the lowest point of the groove.

Upon detonation, the pointed shaft is driven through the plate aperture and into the wall of the cabinet thereby fastening the fastener plate to the wall. In one embodiment, the body wall of the cartridge separates at the lowest point of the groove by the force of expanding gases in the explosion chamber after the piston head and shaft are driven into the wall. A ring is left within the tabs that can be left in place or removed as desired.

The fastener plate may also include one or more anchors that further secure the fastener plate and track to the structural members of the cabinet. Alternatively, the track can be further secured to the cabinet conventionally using screws through holes typically provided in the tracks by slide manufacturers.

In another embodiment, the fastener assembly also includes a cartridge with a number of capsules of adhesive placed around the shaft in the chamber below the piston head. The fastener plate in this embodiment has several additional apertures or slots surrounding the aperture that receives the shaft to allow the expulsion of adhesive through the plate. The fastener plate may also have an indentation or raised area below the apertures such that a small gap is formed when the fastener plate is flush with the sidewall of the cabinet.

Upon detonation, the capsules are burst open by the piston head and the encapsulated adhesive is driven through the apertures and thereafter occupies the space between the fastener plate and the cabinet wall or support member. The tack secures the position of the track and plate while the adhesive is allowed to cure.

Alternatively, the cartridge of the fastener assembly does not have a shaft on the piston head. In this embodiment, the fastener plate is secured by extruded adhesive alone. This embodiment is appropriate when the sidewall of the cabinet is metal or the wall is too thin or cannot otherwise receive a tack shaft.

In another embodiment, the fastener plate has two or more cartridges positioned over apertures in the plate. The fastener plate in this embodiment has several sets of pound in anchors. These anchors are pounded into the sidewalls of the cabinet after the fastener plate and track are properly aligned and the charge has been detonated. This embodiment is adapted for use with long drawers with tracks that may need to support a substantial amount of weight.

A further embodiment of the invention is adapted for use with the center track or American type slide assembly characterized by tracks that are secured to the back wall of the cabinet by brackets. In this embodiment, the cartridge is mounted to the bracket that connects with the track. Once the bracket is properly positioned, the charge is detonated and the bracket is secured to the rear wall or support structure. Screws, as needed, may further secure the bracket to the rear wall of the cabinet.

Another embodiment of the invention is adapted for use with a generally "L" shaped adjustable bracket. One leg of the bracket is mounted to a block of wood with screws residing in slots in the bracket and positioned so that the other leg of the bracket is against the rear wall of the cabinet. The side rail is also mounted to the wood, which serves to stiffen and support the rail. Once the drawer with the mounted slide and wooden block are in the proper position, the charge is detonated driving the fastener through the bracket thereby securing the bracket to the back of the cabinet.

Yet another embodiment of the invention is adapted for use with full extension slide hardware. The alignment and attachment of the full extension type of slide is the same as with the European type of slide.

An object of the invention is to allow the quick and efficient installation of drawer slides.

Another object of the invention is to provide a drawer slide that is self-aligning obviating the need for repetitive re-measurements.

Yet another object of the invention is to provide an easy way to orient and secure elongate members within confined spaces with a minimum of effort.

Still another object of the invention is to provide a mounting apparatus and method that can be economically manufactured and can be discarded after a single use.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings that are for illustrative purposes only.

DETAILED DESCRIPTION OF THE INVENTION

Referring more specifically to the drawings, for illustrative purposes the present invention is embodied in the apparatus and method generally shown in FIG. 1 and FIG. 3 through FIG. 23, where like reference numbers denote like parts. It will be appreciated that the apparatus may vary as to configuration and as to details of the parts, and that the method may vary as to steps and their sequence, without departing from the basic inventive concepts disclosed herein.

Figure 1:
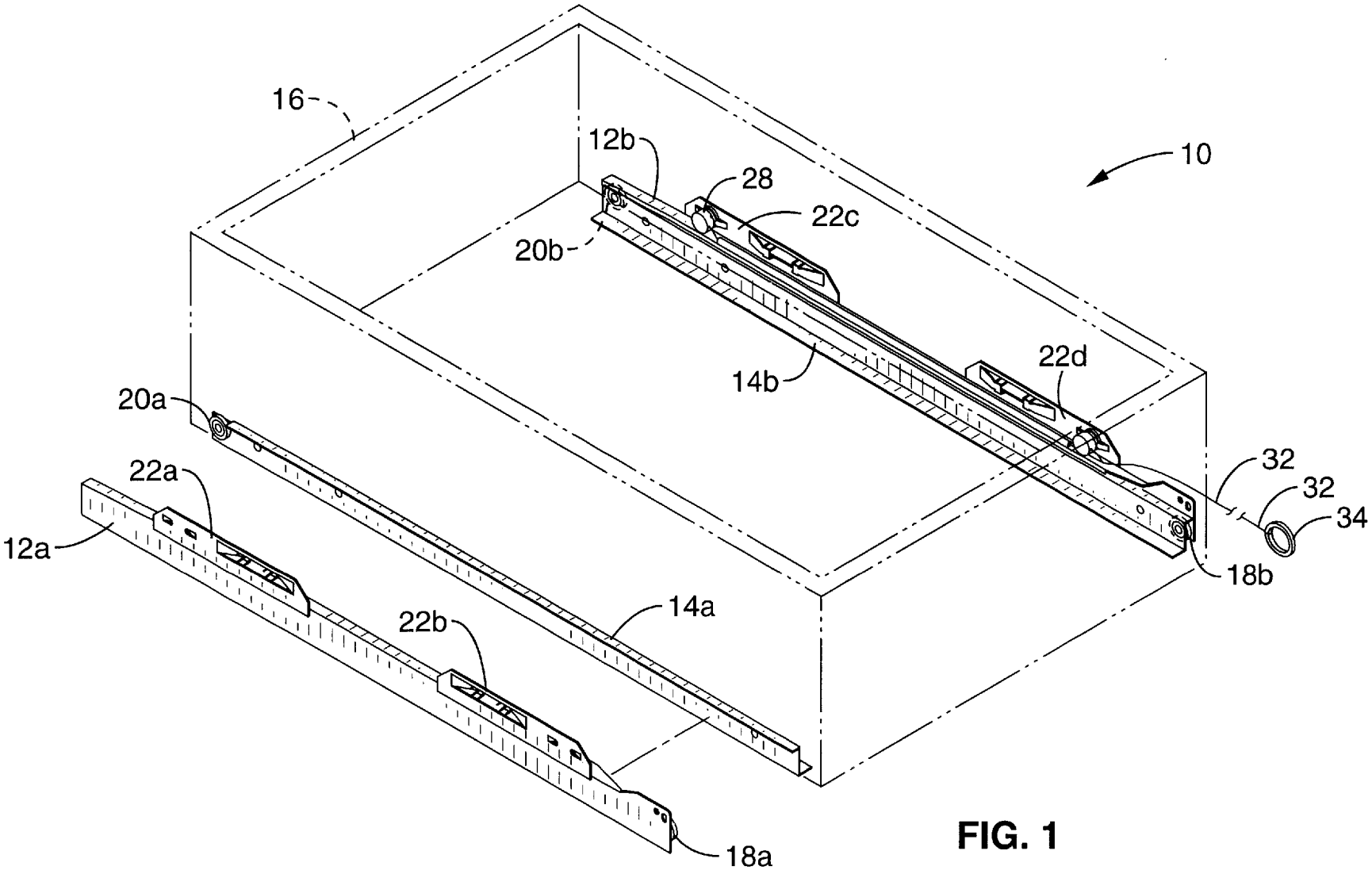
FIG. 1 is a perspective view of an embodiment of a drawer slide mounting apparatus according to the present invention adapted for use with the European type drawer with the body of the drawer shown in phantom lines.

Referring first to FIG. 1, a European type drawer slide 10 in accordance with the invention is generally shown in context of attachment to a drawer shown in phantom lines. Typical drawer slides include a track 12*a* and a rail 14*a* that engage and slide longitudinally with respect to each other. The rail 14*a* is mounted to the body of the drawer 16, and the track 12*a* is mounted to the side of the cabinet. A corresponding track 12*b* and rail 14*b* are mounted on the opposite side of the drawer body 16 and the cabinet.

Movement of the rail 14*a* with respect to track 12*a* is preferably facilitated by wheel 18*a* on track 12*a* and wheel 20*a* on rail 14*a*. Corresponding wheel 18*b* is disposed on track 12*b* and wheel 20*b* is disposed on rail 14*b*. This allows for the easy movement of the drawer regardless of the weight of the objects present in the drawer.

In the embodiment shown in FIG. 1, there are two fastener assemblies 22*a*, 22*b* mounted to track 12*a*, and two fastener assemblies 22*c*, 22*d* mounted to track 12*b*. It will be understood that the planar fastener assemblies can be mounted to an existing track 12 after manufacture as an add-on feature or integrated into the track at the time of manufacture. The fastener assemblies 22*a*, 22*b* are preferably mounted on the track 12*a* so as to extend upwardly as shown in FIG. 1. Fastener assemblies 22*c*, 22*d* may be mounted to track 12*b* in like fashion.

Figure 2:
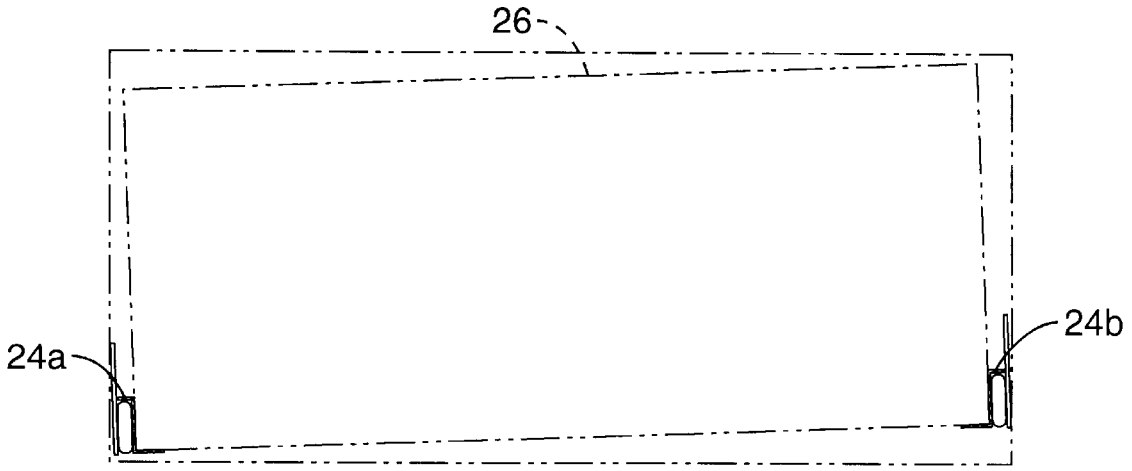
FIG. 2 (Prior Art)
FIG. 2 is a front view of a drawer shown in phantom lines with the front panel removed and showing two prior art drawer slides that are not properly aligned within the cabinet.
Figure 3:
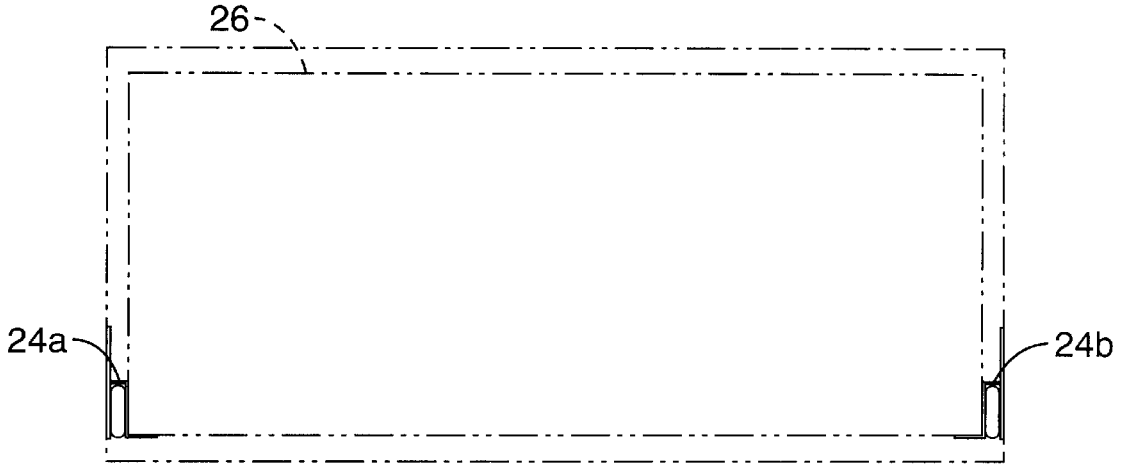
FIG. 3 is a front view of a drawer in phantom lines with the front removed and showing two prior art drawer slides that have been properly aligned within the cabinet.

Turning now to FIG. 2, the improper placement of the prior art drawer slides 24*a*, 24*b* and the corresponding positions of the body of the drawer within the cabinet opening can be seen. Proper placement of the drawer slides 24*a*, 24*b* is essential for proper alignment of the drawer face and the smooth function of the slides. In FIG. 2, the vertical position of the left drawer slide 24*a* is lower than the vertical position of slide 24*b*, which is indicative of improper alignment. Improper alignment can occur when the cabinet is installed in a space where the walls and floor are not perfectly upright or level. Improper alignment of prior art slides can also occur during the installation of the tracks of slides 24*a*, 24*b* that requires the repeated removal of the drawer body 26 and the placement of screws. Improper vertical and horizontal alignment of the slides 24*a*, 24*b* can result in the binding of drawer slides during movement of the drawer. In contrast, FIG. 3 shows proper placement, as can be achieved with the present invention. The present invention allows the proper horizontal and vertical alignment of the slides and drawer face even if the walls of the cabinet are not perfectly square.

Figure 4:
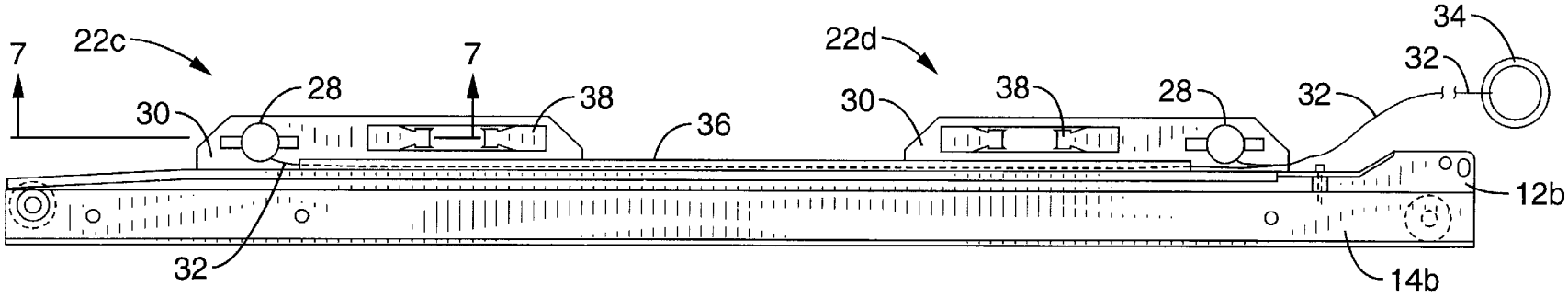
FIG. 4 is a side view of a European type slide adapted with a mounting apparatus according to the present invention.

Referring now to FIG. 4, which shows the right side slide assembly in FIG. 1, rail 14*b* engages and slides within track 12*b*. Mounted to track 12*b* are two fastener assemblies 22*c* and 22*d* in the embodiment shown. The fastener assemblies 22*c*, 22*d* may be mounted to existing drawer slide hardware known in the art or newly manufactured as an integrated unit with the track. Fastener assemblies 22*c*, 22*d* are preferably equally spaced along the length of the track 12*b*. The use of two or more spaced fastener assemblies 22*c*, 22*d* permits the track 12*b* and rail 14*b* to be any desired length and therefore adaptable to any drawer size.

Each fastener assembly 22*c*, 22*d* includes a cartridge 28, a fastener plate 30, a lanyard 32 and a pull ring 34. Lanyard 32 may be disposed within a lanyard guide 36 to avoid entanglement of the lanyard during installation and use. Cartridge 28 preferably contains a self-detonating explosive charge initiated by lanyard 32 and a tack or nail that is driven through an aperture in plate 30 and into the sidewall of the cabinet upon detonation.

Optionally, the fastener plate 30 may have one or more pronged fastener arms 38 that may be pounded in to further secure the fastener plate 30 to the sidewall of the cabinet. Alternatively, fastener plate 30 may have holes to receive screws to anchor the fastener plate to the cabinet sidewall (not shown). Or, screws inserted into factory provided holes in track 12*b* may further secure track 12*b* to the wall of the cabinet.

Figure 5:
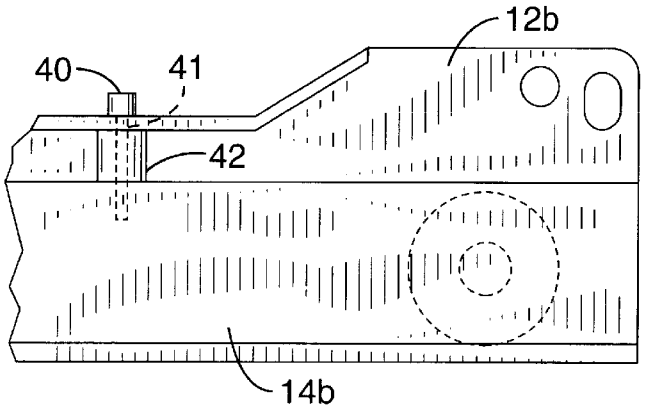
FIG. 5 is a detailed sectional side view of one end of the European type slide of FIG. 4 showing the preferred coupling pin.

Referring also to FIG. 5, track 12*b* and rail 14*b* are preferably locked together during transportation and installation with a lock pin 40. The lock pin 40 is placed vertically in a pinhole 41 in track 12*b* and through a corresponding pinhole in rail 14*b*. Lock pin 40 may also have a collar 42 that frictionally engages the lock pin and prohibits the accidental removal of the pin. In addition, lock pin 40 is preferably made of a brittle plastic material that can be shattered or sheared after installation.

Figure 6:
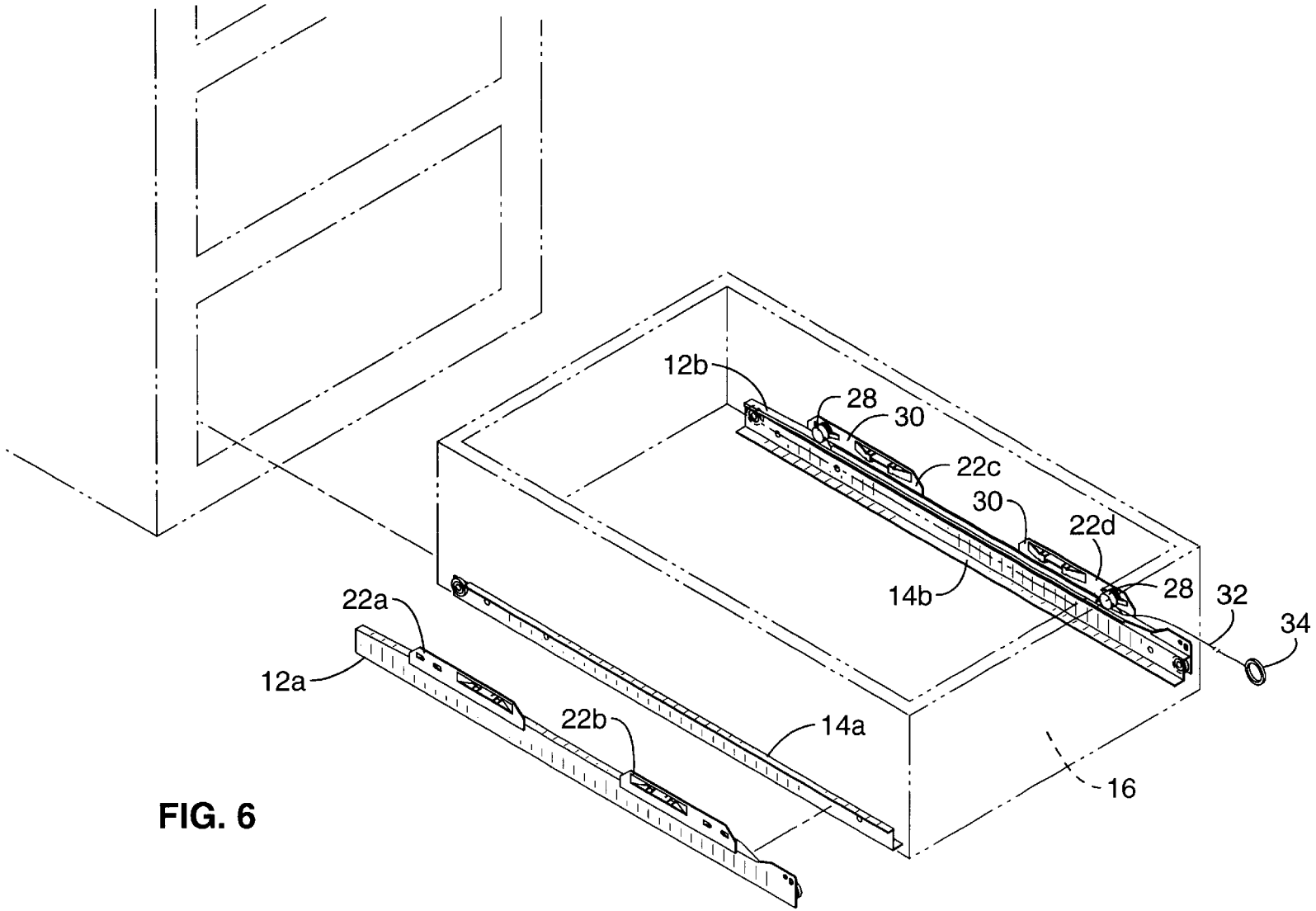
FIG. 6 is a perspective view of the European type drawer slides of one embodiment of the present invention with the drawer ready for placement and alignment within the body of the cabinet, wherein the drawer and cabinet are depicted in phantom lines.

In use, as can be seen with further reference to FIG. 6, rails 14*a* and 14*b* are mounted to the body of the drawer 16. Tracks 12*a* and 12*b* are positioned to engage the corresponding rails 14*a* and 14*b*, respectively. A lock pin 40 is placed through the pinhole 41 in each track 12*a*, 12*b*, through a collar 42 and down through the corresponding pinholes in rails 14*a*, 14*b* thereby locking the rails and tracks together. The drawer with the slides can then be placed into the cabinet for positioning. For new cabinet construction, the cabinet may be placed on its back with the drawers and frame facing upward. For repairing or remodeling of previously installed cabinets, the drawers will necessarily be horizontal. The horizontal and vertical position of the face of the drawer with respect to the other drawers in the cabinet can be properly determined.

Once the drawer 16 is positioned, the user pulls ring 34 which draws the lanyard 32 and in turn detonates the charge in cartridge 28 forcing the tack or nail into the side wall of the cabinet. All of the cartridges 28 are activated to firmly secure the tracks 12*a*, 12*b* to the cabinet. The drawer can then be removed by pulling and shearing the anchor pin 40.

The tracks 12*a*, 12*b* may be further anchored by hammering pronged fastener arms 38 into each of the sidewalls of the cabinet. Alternatively, the tracks 12*a*, 12*b* can be further anchored using screws placed in holes in the tracks conventionally present for mounting such tracks.

Figure 7:
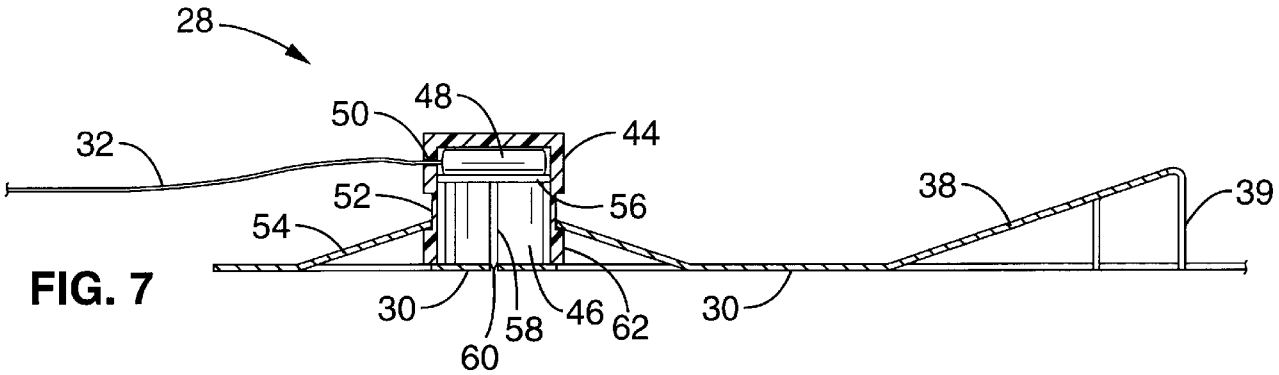
FIG. 7 is a cross-sectional side view of the fastener plate of the European type embodiment of the present invention taken along the lines 7—7 of FIG. 4 depicting the tack only embodiment of the invention prior to detonation of the charge.
Figure 8:
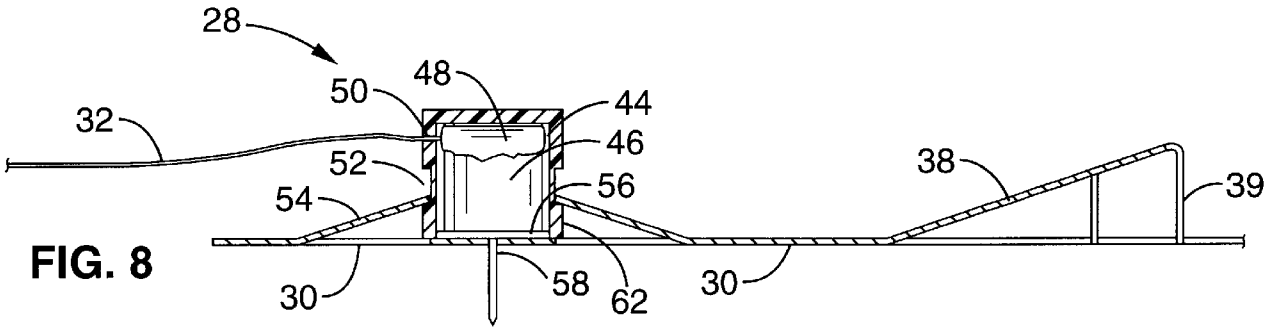
FIG. 8 is a cross-sectional side view of the fastener plate of the European type embodiment of the present invention taken along the lines 7—7 of FIG. 4 depicting the tack only embodiment of the invention immediately after detonation of the charge.
Figure 9:
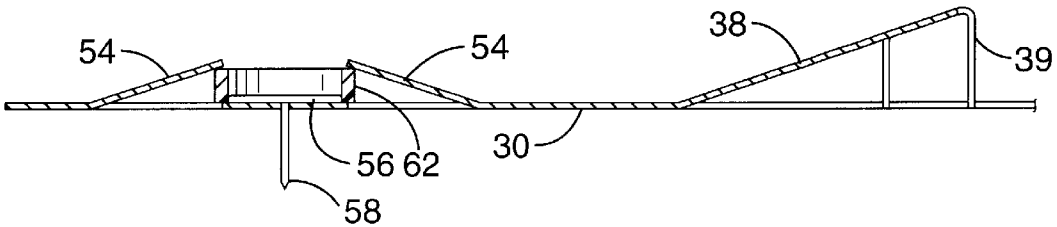
FIG. 9 is a cross-sectional side view of the fastener plate of the tack only embodiment of the invention taken along the lines 7—7 of FIG. 4 after the tack has been fully driven by the force of the charge and a portion of the cartridge has been separated and removed.

As can be seen in FIG. 7 through FIG. 14, there are three embodiments of cartridge 28, namely, a tack only, an adhesive and tack combination, and an adhesive only embodiment. In FIG. 7, FIG. 8 and FIG. 9, a cross-section of the tack only embodiment can be seen. Cartridge 28 has a generally cylindrical body 44 with an open end and a closed end forming an explosion chamber 46. Chamber 46 contains an explosive charge 48 positioned at the closed end of chamber 46. Lanyard 32 is connected to the charge 48 through a small aperture 50 in the body wall 44 to explosion chamber 46. The distal end of lanyard 32 is disposed within the explosive charge 48 and frictionally detonates the explosive charge 48 when the lanyard 32 is pulled. While the frictional initiation of the explosive charge 48 is disclosed, it will be understood that any type of detonation device or method will work without departing from the invention.

The cylindrical body 44 of cartridge 28 preferably has a circumferential groove 52 on the exterior of the body. Tabs 54 in fastener plate 30 engage and releasably secure the cartridge 28 to fastener plate 30 in the proper orientation.

In the embodiment shown in FIG. 7 through FIG. 9, charge 48 is enclosed within chamber 46 by piston (e.g., tack) defined by a piston head 56 and a pointed shaft 58. The pointed shaft 58 is fixed perpendicularly to the piston head 56 on the side opposite the charge 48 and directed to the open end of the chamber 46. As seen in FIG. 8, the pulling of the lanyard 32 detonates explosive charge 48, which drives piston head 56 and shaft 58 through a hole 60 in fastener plate 30 thereby driving shaft 58 into the sidewall of the cabinet and fastener plate 30. Fastener plate 30 may be further anchored to the cabinet sidewall by pronged fastener arms 38. The preferred fastener arm 38 has one or more prongs or tines 39 that can be pounded in with a hammer to further secure, fastener plate 30 to the cabinet after the plate is aligned.

Referring also to FIG. 9, the wall of groove 52 of cartridge body 44 is preferably reduced to approximately 0.001 inches in thickness that will allow the top section of cartridge body 44 to separate from the lower section 62 of body 44 which remains secured by tabs 54 after detonation. In the preferred embodiment, the groove 52 has a wall thickness that tapers from approximately 0.008" inches at the top of the groove to 0.004" at the bottom of the groove 52. This optional taper permits a clean break at the same location on the circumference of the groove 52 leaving ring shaped section 62 in tabs 54. Alternatively, the body 44 of cartridge 28 can be removed from tabs 54 of fastener plate 30 or left in place after detonation.

It is preferred that explosive charge 48 have the capability of producing at least 20 pounds of force against piston head 56 to drive the shaft 58. Suitable explosive compounds include fulminate of mercury, fulminate of silver, lead azide and silver azide and other compounds with similar characteristics.

Figure 10:
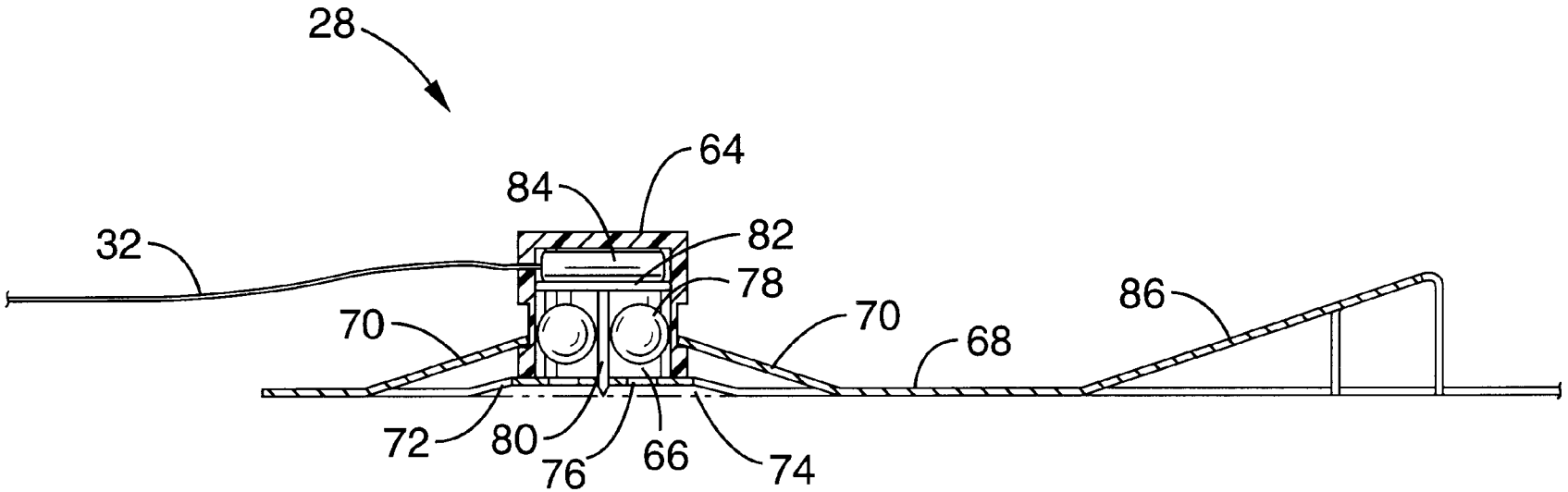
FIG. 10 is a cross-sectional side view of the fastener plate of an alternative embodiment of the present invention taken along the lines 7—7 of FIG. 4 depicting the tack and adhesive embodiment of the invention prior to detonation.
Figure 11:
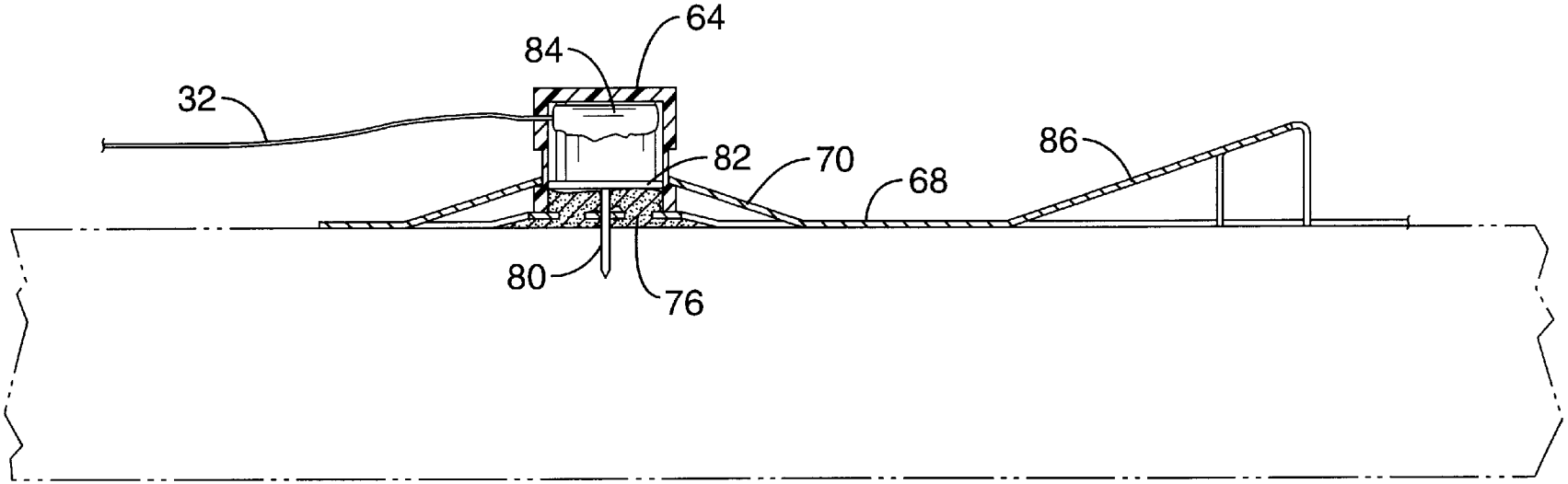
FIG 11 is a cross-sectional side view of the fastener plate of an alternative embodiment of the present invention taken along the lines 7—7 of FIG. 4 depicting the tack and adhesive embodiment of the invention immediately after detonation.
Figure 12:
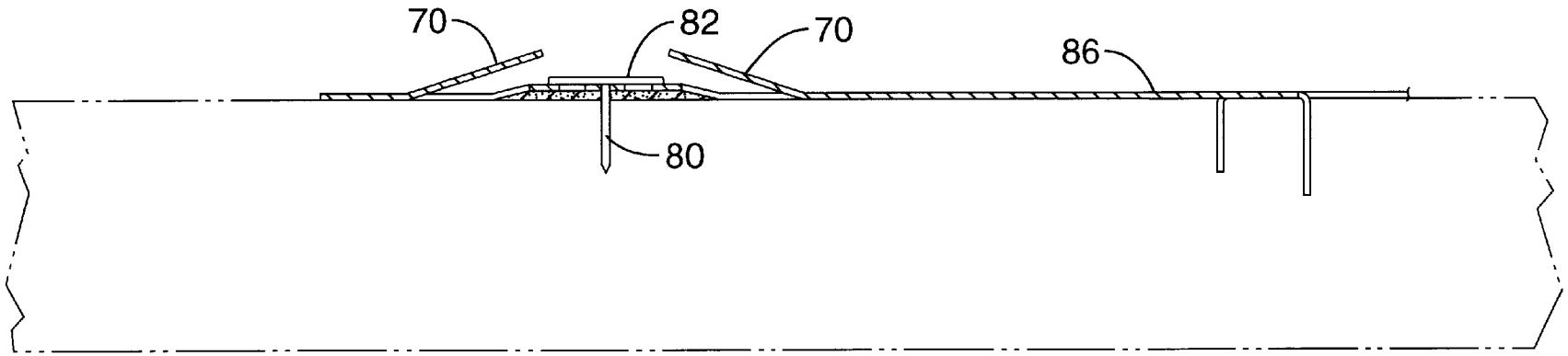
FIG. 12 is a cross-sectional side view of the fastener plate of an alternative embodiment of the present invention taken along the lines 7—7 of FIG. 4 depicting the tack and adhesive embodiment of the invention after detonation and removal of the cartridge. One of the pronged fastener arms has also been pounded into the sidewall of the cabinet in this view.

The tack and adhesive embodiment of the cartridge 28 of the invention and alternative fastener plate 68 are shown in FIG. 10 through FIG. 12. As shown in FIG. 10, this embodiment of the cartridge 28 has a cartridge body 64 with an explosion chamber 66 that is positioned on fastener plate 68 with tabs 70. In this embodiment, fastener plate 68 preferably has a raised portion 72, which forms a space 74 when the fastener plate 68 is flush with the sidewall of the cabinet. The cartridge body 64 and explosion chamber 66 are positioned over slots or holes 76 in the raised section 72.

One or more capsules of encapsulated adhesive 78 are preferably disposed in explosion chamber 66 surrounding shaft 80 and below piston head 82. As shown in FIG. 11, detonation of explosive charge 84 drives piston head 82 downward bursting the adhesive capsules 78 and forcing the adhesive through slots 76 in raised portion 72 of fastener plate 68 and into space 74. At the same time, shaft 80 is driven into the sidewall of the cabinet securing fastener plate 68. In time, the adhesive will cure providing a permanent bond between the fastener plate 68 and the cabinet wall.

Additionally, the fastener plate 68 can have pronged fastener arms 86 that can be pounded in after the tracks and rails are aligned and fixed as seen in FIG. 12. Cartridge body 64 can also be removed from tabs 70 after the discharge or left in place.

Figure 13:
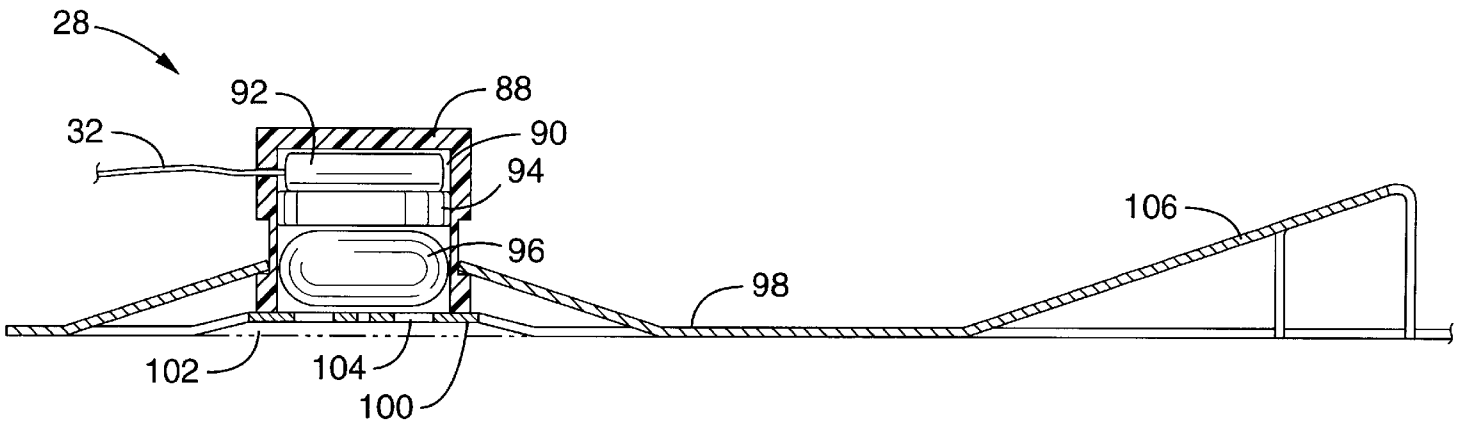
FIG. 13 is a cross-sectional side view of the fastener plate of an alternative embodiment of the present invention taken along the lines 7—7 of FIG. 4 depicting the adhesive only embodiment of the invention prior to detonation.
Figure 14:
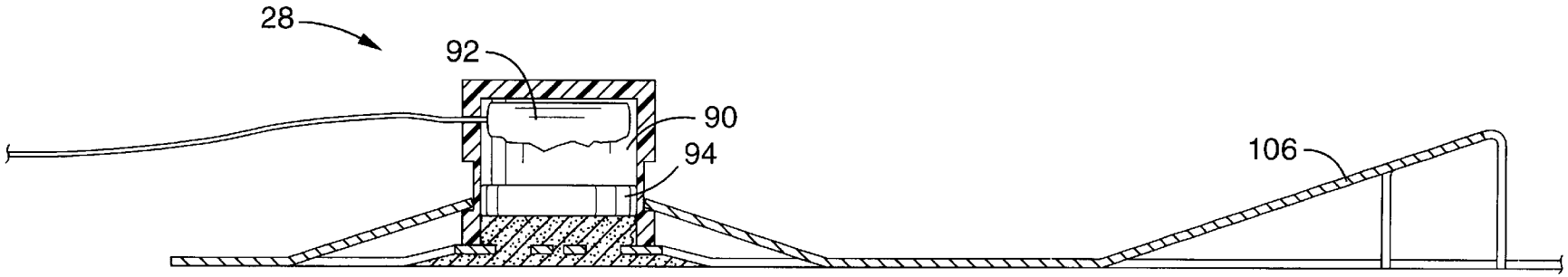
FIG. 14 is a cross-sectional side view of the fastener plate of an alternative embodiment of the present invention taken along the lines 7—7 of FIG. 4 depicting the adhesive only embodiment of the invention immediately after detonation.

The adhesive only embodiment of the cartridge 28 is shown in FIG. 13 and FIG. 14. The cartridge body 88 has an explosion chamber 90 that encloses an explosive charge 92. A piston head 94 resides within chamber 90 and is disposed between charge 92 and adhesive 96. Fastener plate 98 preferably has a raised section 100 forming a space 102, which communicates with the chamber through slots or apertures 104 in section 100. Fastener plate 98, in the embodiment shown, has the same structural characteristics as fastener plate 68 previously described.

Upon placement of the drawer and detonation of charge 92, the adhesive 96 is forced through slots 104 and into space 102 to form a bond to the side of the cabinet. With this embodiment, the drawer is not removed until the adhesive has had sufficient time to set. Optionally, fastener arms 106 may be pounded into the sides of the cabinet to further anchor the fastener plate 98. However, the fastener arms 106 would not be suitable for use with walls made of metal or other hard materials as well as thin or very soft materials that could be damaged by the pronged fastener arms 106.

Figure 15:
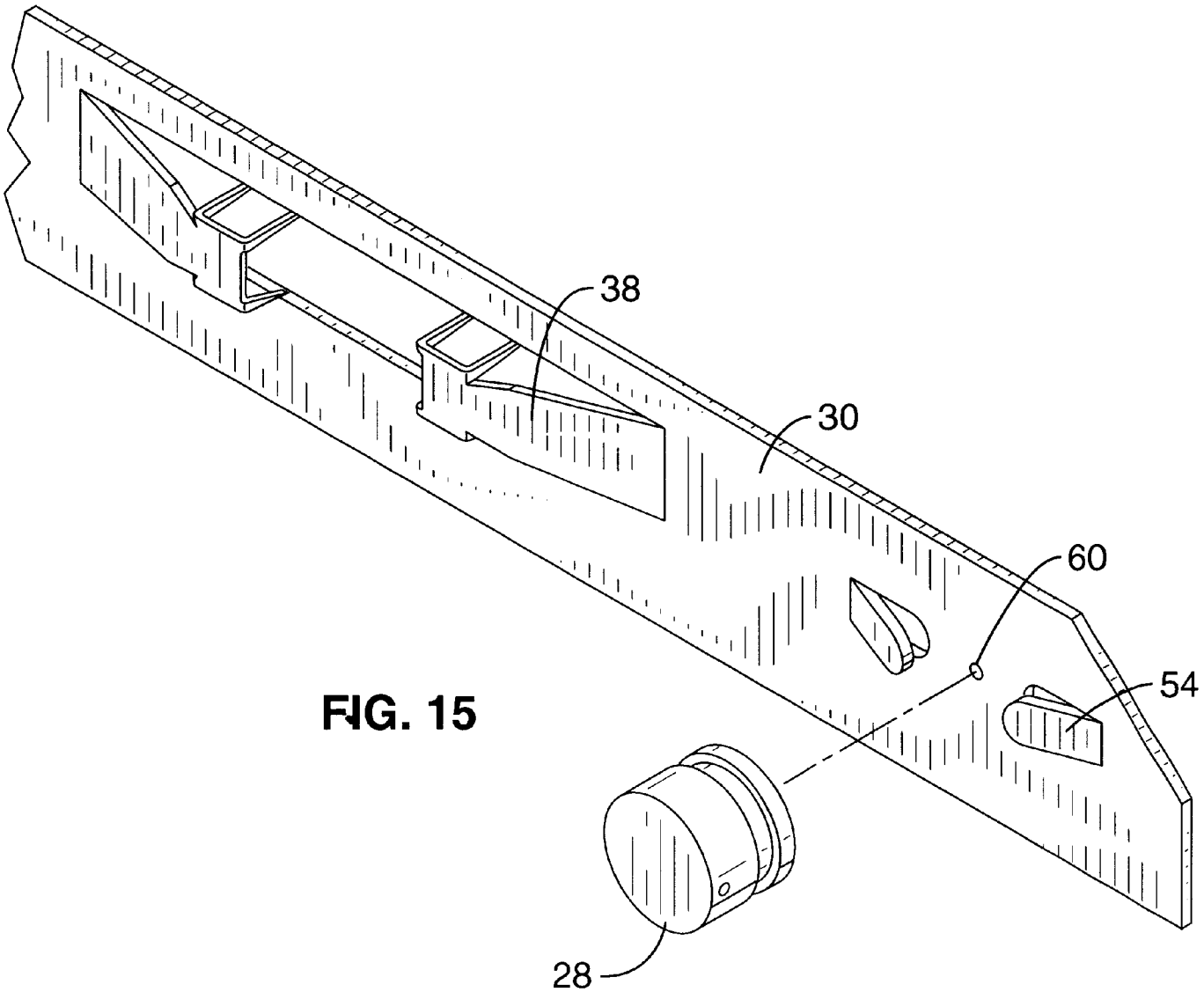
FIG. 15 is a detailed perspective view of a section of the fastener plate of the tack only embodiment of the invention.

Referring now to FIG. 15, the fastener plate 30 of a tack only embodiment of the invention is shown prior to placement of cartridge 28. It can be seen that the body 44 of cartridge 28 can be positioned with tabs 54 over aperture 60 such that shaft 58 and piston head 56 will fasten the fastener plate 30 upon discharge of the explosive charge.

Figure 16:
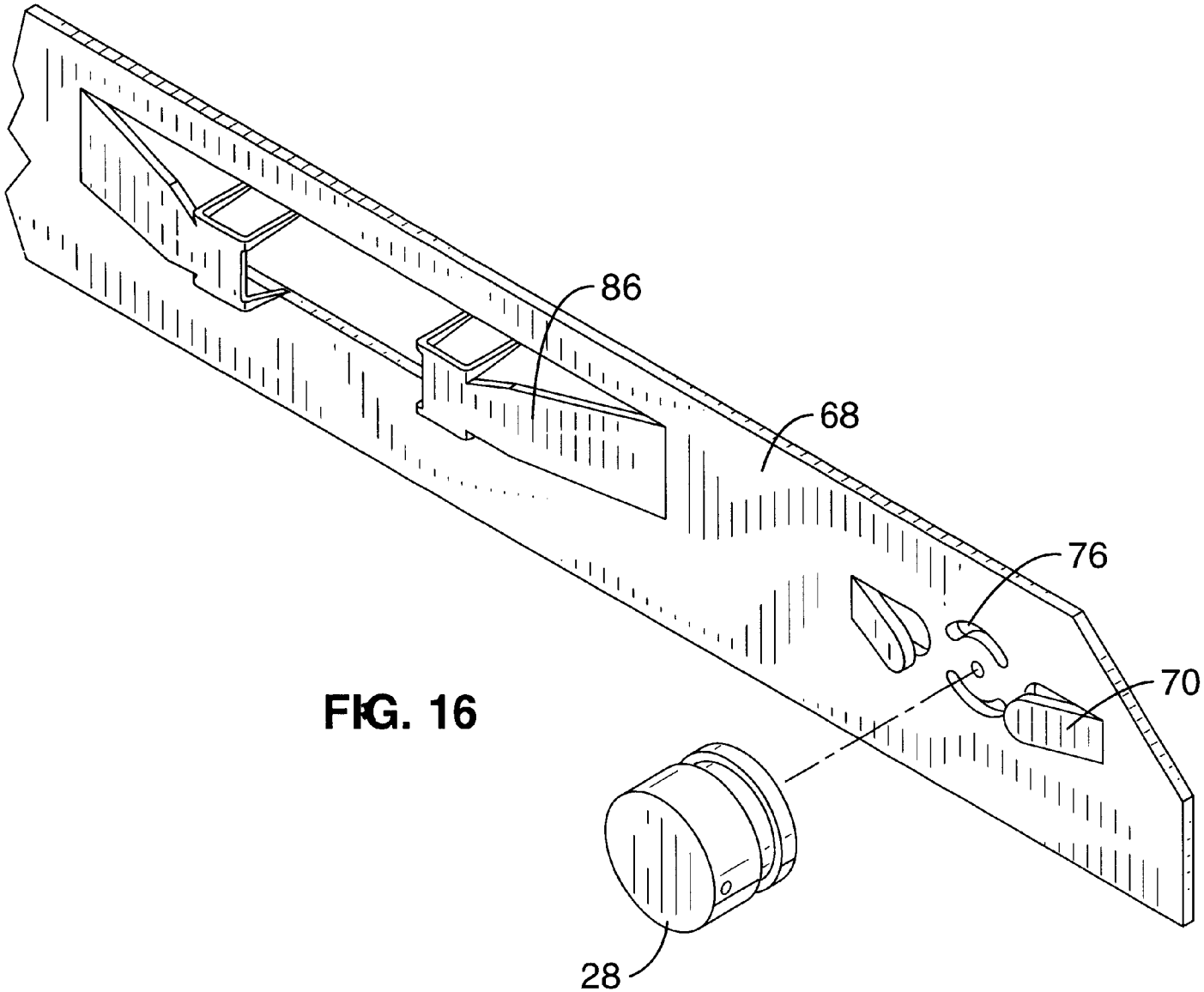
FIG. 16 is a detailed perspective view of a section of the fastener plate of the tack and adhesive and adhesive only embodiments of the invention.

The fastener plate shown in FIG. 16 may be used with the tack and adhesive and adhesive only embodiments of cartridge 28. Fastener plate 68 (or 98) has slots or apertures 76 that allow the adhesive and tack or adhesive alone embodiments of cartridge 28 to fasten plate 68 to the sidewall of the cabinet.

Figure 17:
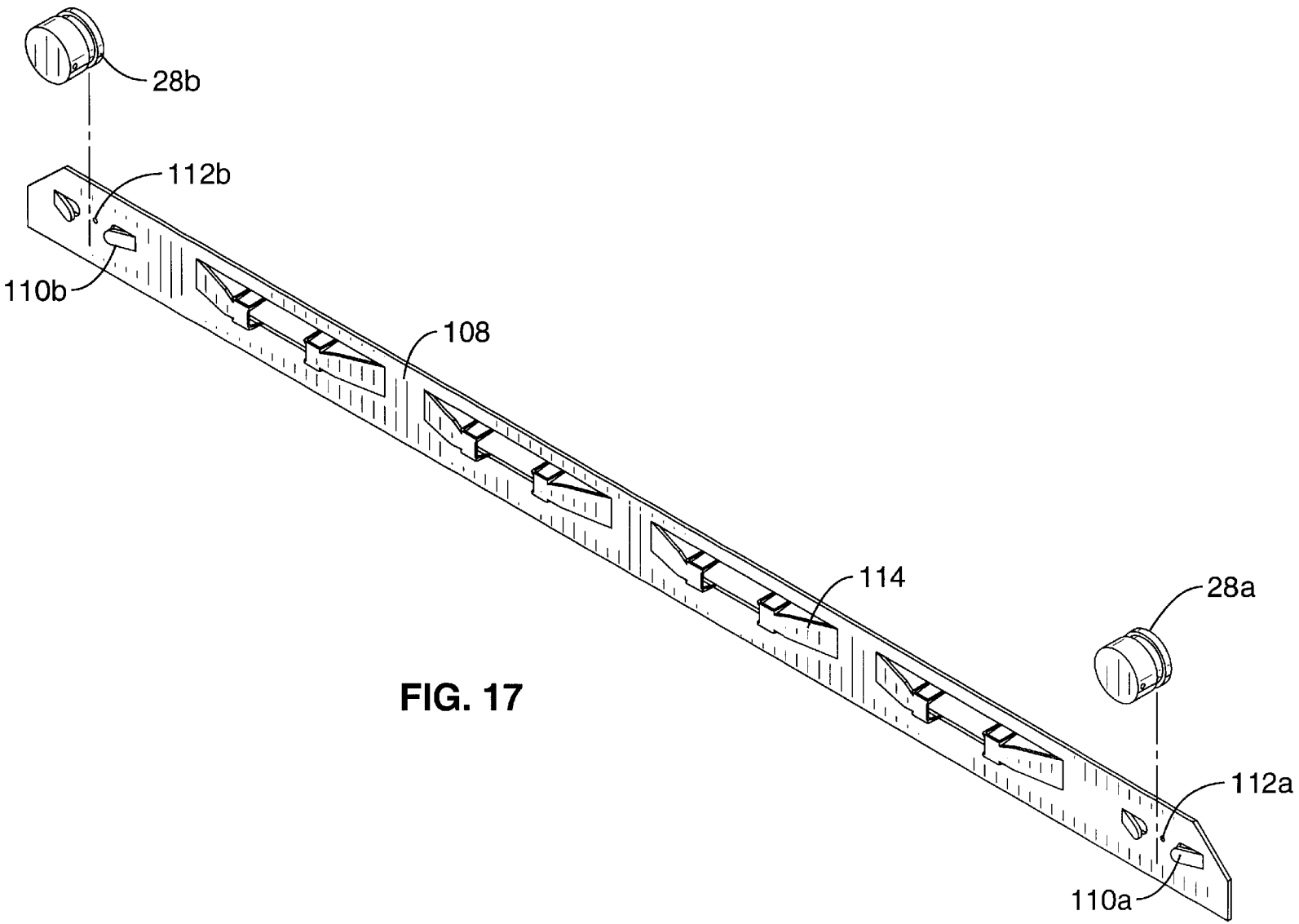
FIG. 17 is a perspective view of an alternative embodiment of the fastener plate of the invention with multiple fastener arms.

An alternative embodiment of a fastener plate of the invention is shown in FIG. 17. Fastener plate 108 has two sets of tabs 110*a*, 110*b* that can receive and position two cartridges 28*a* and 28*b*. Cartridges 28*a* and 28*b* are positioned over apertures 112*a* and 112*b* respectively such that the shaft of the tack of cartridge 28 (not shown) will be driven through the aperture upon detonation. Additionally, there are four sets of optional pronged fastener arms 114 arranged linearly along the length of fastener plate 108. In this embodiment, the track (not shown) can be aligned and the cartridges 28*a* and 28*b* activated sequentially.

Figure 18:
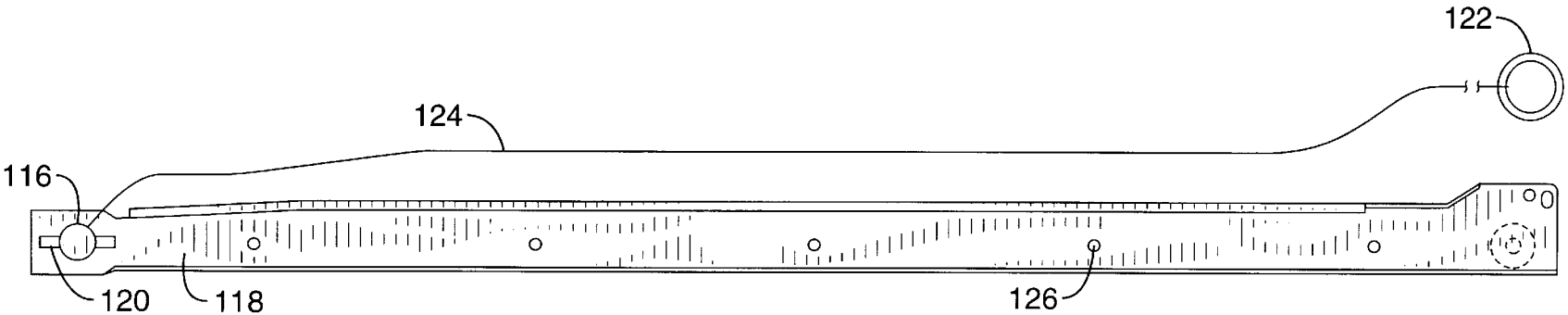
FIG. 18 is a side view of an alternative embodiment of the present invention with the cartridge positioned at the end of the track section and the rail removed.

Turning now to FIG. 18, an alternative embodiment of the invention is shown that does not have a fastener plate mounted to the top or bottom of the track. Instead, the cartridge 116 is mounted to the end of the track 118 with tabs 120. Once oriented, the user pulls ring 122 and lanyard 124 thereby detonating the charge of cartridge 116 and driving a tack or shaft into the sidewall of the cabinet. The track 118 may be further secured by the placement of screws in holes 126 of track 118. It can be seen that in this embodiment the tack serves to fix the position of the track 118 and facilitate the conventional permanent anchoring of the track 118 with screws. In FIG. 18, cartridge 116, tabs 120, lanyard 124 and ring 122 are structurally the same as cartridge 28, tab 54, lanyard 32 and ring 34 described previously in FIG. 16.

Figure 19:
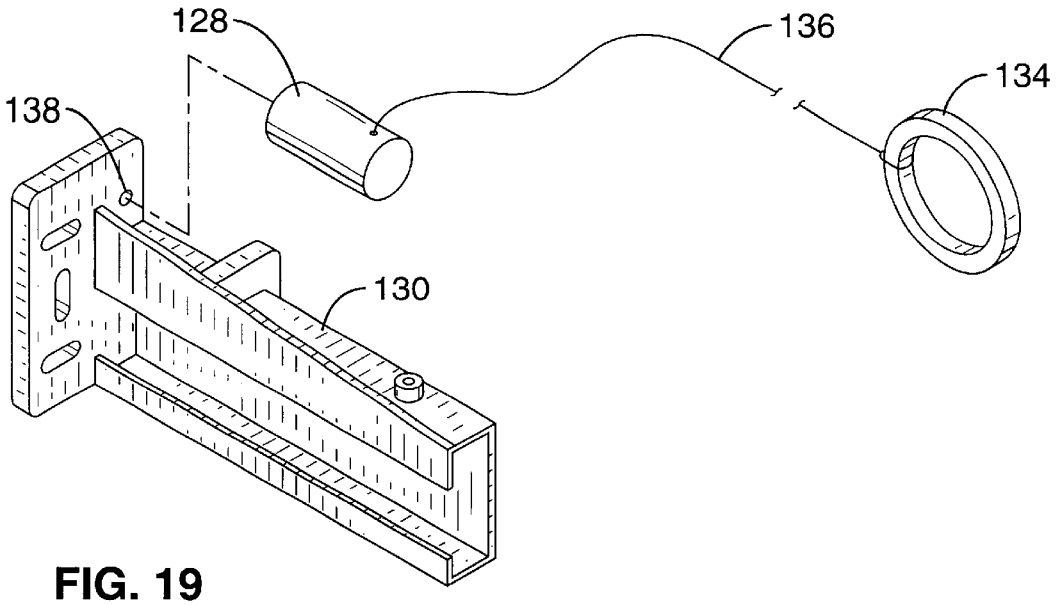
FIG. 19 is a perspective view of the American type embodiment of the present invention with the cartridge removed.
Figure 20:
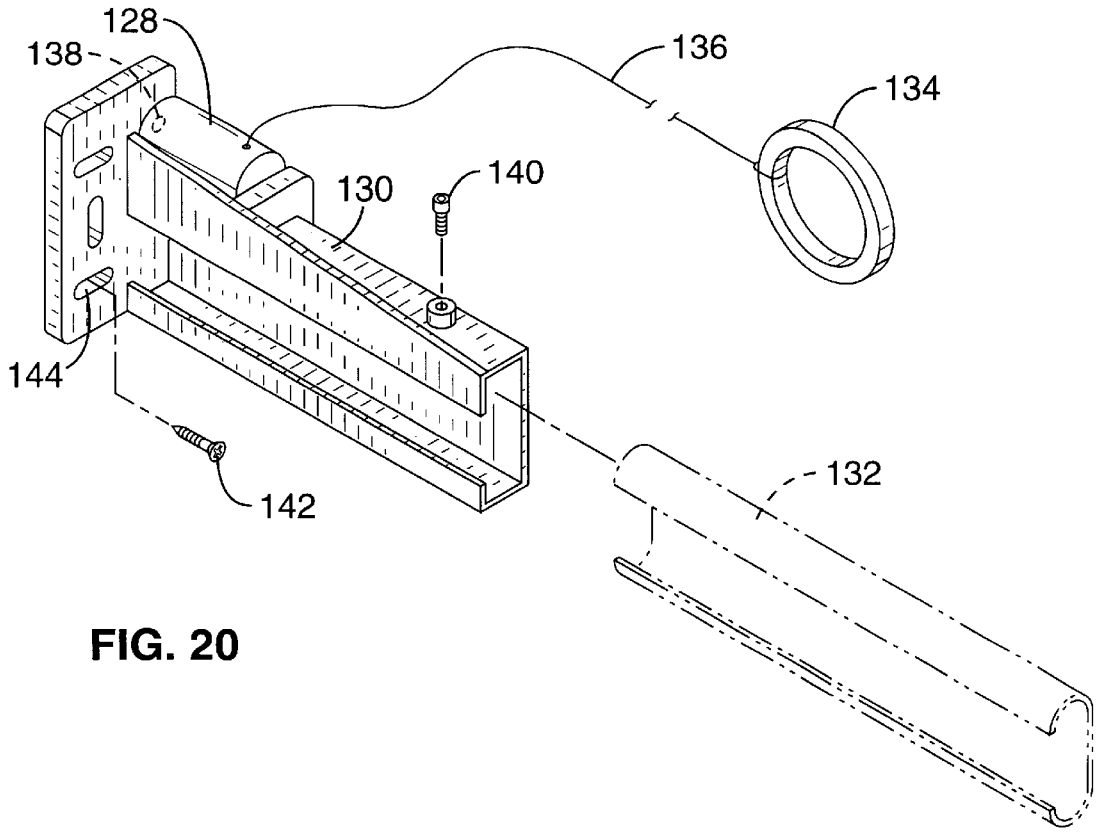
FIG. 20 is a perspective view of the American type embodiment of the present invention with the cartridge in place.

Turning now to FIG. 19 and FIG. 20, an alternative embodiment of the invention adapted for the American type of drawer slide is shown. In this embodiment, cartridge 128 has a chamber that encloses an explosive charge, piston head and shaft. The glue and tack and glue only embodiments of the cartridge 128 may also be used.

Cartridge 128 is adapted to fit a bracket 130. The bracket 130 is capable of securing one end of track 132. Bracket 130 is also capable of being secured to the back wall of the cabinet that is generally perpendicular to the length of track 132.

In use, the rails are mounted to the body of the drawer (not shown) and track 132 and the rail are coupled. A bracket 130 is placed at the distal end of each of the tracks 132. It will be understood that bracket 130 may be right handed or left handed in orientation. The drawer and slides are then placed in the opening of the cabinet and horizontally and vertically aligned. Bracket 130 is positioned along the back wall of the cabinet. Bracket 130 may optionally have a setscrew 140 that fixes the length of the track 132 and bracket 130 within the cabinet.

Once aligned, the user pulls on ring 134 and lanyard 136 detonating the charge and driving the tack shaft (not shown) through hole 138 and into the back wall of the cabinet thereby fixing the position of the bracket 130 and track 132. The drawer is then removed from the cabinet and anchor screw 142 may be placed in bracket hole 144 to further anchor the bracket 130 to the rear wall or structural member of the cabinet.

Figure 21:
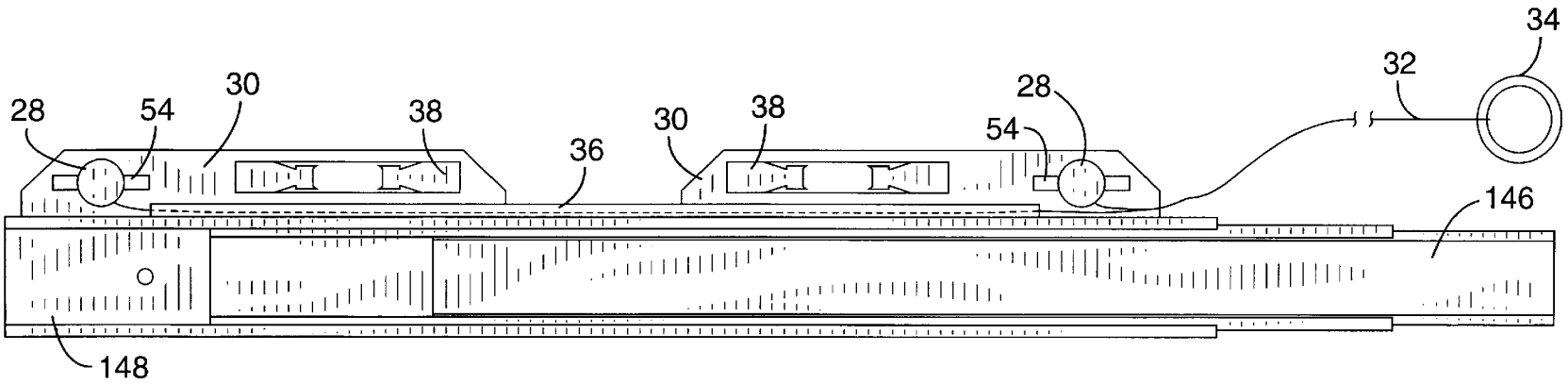
FIG. 21 is a side view of the full extension hardware embodiment of the present invention.

Referring to FIG. 21, an alternative embodiment of the invention adapted for use with full extension slide hardware is seen. In the embodiment shown, the right side slide assembly has a pair of fastener plates 30 that are mounted to the outer slide member 148. It will be understood that plates 30 can be mounted at the top, end or bottom of outer slide member 148. Plates 30 have cartridges 28 held in position by tabs 54.

In use, a drawer is mounted to inner slide member 146 with screws (not shown). The drawer with the full extension hardware is placed in the cabinet and the face of the drawer is horizontally and vertically aligned. The user initiates the explosion in cartridges 28 thereby fixing the plates 30 and outer slide member 148 to the interior sidewall of the cabinet. Optional pronged fastener arms 38 can be pounded in to further secure plate 30 to the wall of the cabinet.

Figure 22:
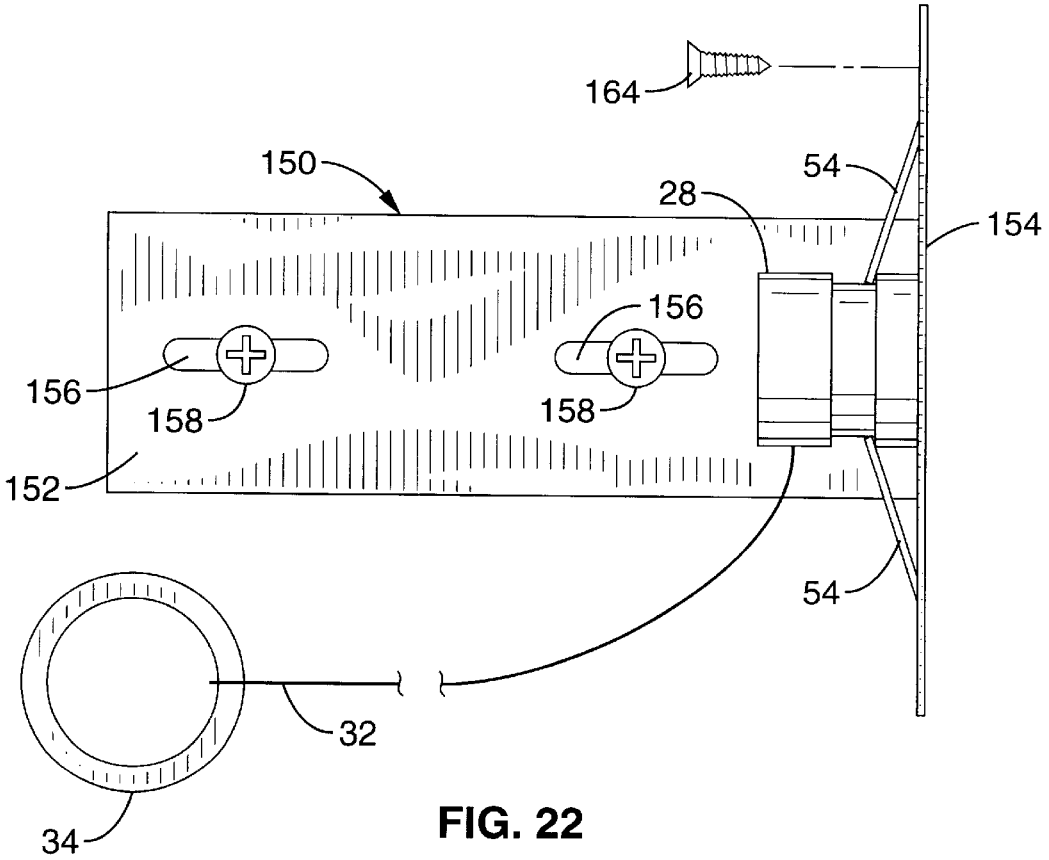
FIG. 22 is a top view of an alternative bracket embodiment of the present invention that is aligned and mounted to the back of the cabinet.
Figure 23:
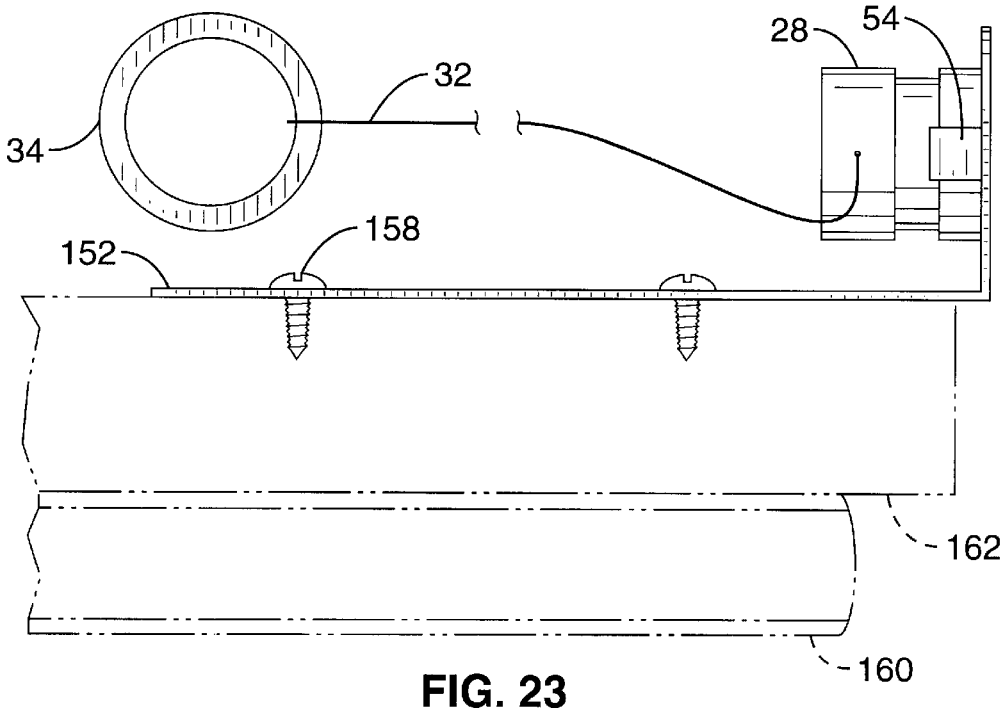
FIG. 23 is a side view of the alternative bracket embodiment of the present invention shown in FIG. 22.

Turning now to FIG. 22 and FIG. 23, an alternative embodiment of a bracket of the present invention for use with either the American type or the European type slide hardware is shown. The bracket 150 is generally "L" shaped having two planar leg sections 152 and 154 disposed at an approximately 90-degree angle to each other. Section 152 of bracket 150 has one or more slots 156 capable of receiving screws 158. Section 154 of bracket 150 has a cartridge 28 held in position by tabs 54 as well as lanyard 32 and pull ring 34.

In use, the drawer track 160 is mounted to one side of a block of wood 162. Wood block 162 is dimensioned so as to fit between the sidewall of the cabinet and the side of the drawer. Wood block 162 may be sized to the approximate length of the drawer slide track 160 so as to stiffen and support the track 160 when the track is mounted thereon. Bracket 150 is loosely mounted to the wood block 162 by the placement of screws 158 through slots 156 of section 152 of the bracket. Screws 158 are tightened down at a position where section 154 of bracket 150 is flush with the back wall of the cabinet. The combination of the drawer track 160, block 162 and bracket 150 is then coupled with the drawer rail (not shown) and positioned in the cabinet so that the face of the drawer is horizontally and vertically aligned. When aligned, ring 34 and lanyard 32 are pulled initiating the detonation of cartridge 28 securing section 154 of bracket 150 to the rear wall of the cabinet. The bracket 150 may be further anchored to the rear wall of the cabinet by one or more screws 164.

Accordingly, it will be seen that this invention provides a simple and effective way to orient and anchor a linear member using an explosive charge to deliver a mechanical fastener or adhesive. The invention can be particularly adapted for use with any type of drawer hardware known in the art or can be integrated with the structure of the drawer slide.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for aligning sliding drawer hardware during installation in a cabinet or article of furniture, comprising:

(a) a fastener plate;

(b) a cartridge containing an explosive charge, said cartridge coupled to said fastener plate, said cartridge Including a fastener; and (c) a detonation device coupled to said cartridge;

(d) wherein said cartridge contains a piston head disposed between said explosive charge and said fastener;

(e) wherein detonation of said explosive charge expels said fastener through said fastener plate; and (f) wherein said fastener comprises an adhesive material.

2. An alignment and mounting assembly, comprising:

(a) a fastener plate having a plurality of apertures; and (b) a fastener assembly mounted to the fastener plate, said fastener assembly having a body with a chamber positioned contiguously with an aperture of said plate, a piston head, a fastener capable of fastening said plate to a substrate, and means for moving the piston head;

(c) wherein said fastener plate further comprises means for permanently coupling said plate to said substrate, said means for permanently coupling said fastener plate comprising a plurality of arms, said arms having a plurality of tines.

3. An assembly as recited in claim 2, wherein said means for moving said piston head comprises an explosive charge placed within said chamber.

4. An assembly as recited in claim 3, wherein said explosive charge is selected from the group consisting of fulminate of mercury, fulminate of silver, lead azide and silver azide.

5. An assembly as recited in claim 2, wherein said explosive charge further includes means for igniting said charge.

6. An assembly as recited in claim 5, wherein said means for igniting said charge comprises a lanyard coupled to a frictional detonator.

7. An assembly as recited in claim 2, wherein said fastener comprises a shaft disposed on a shaft side of said piston head, wherein the shaft is driven out of said chamber by said means for moving said piston head.

8. An assembly as recited in claim 7, wherein said fastener further comprises adhesive disposed within said chamber on the shaft side of said piston head, and wherein the movement of said piston head ejects said adhesive from said chamber and through said apertures of said plate to allow the formation of an adhesive bond between said fastener plate and said substrate.

9. An assembly as recited in claim 8, wherein said adhesive is encapsulated in at least one capsule disposed in said chamber.

10. An assembly as recited in claim 2, wherein the fastener comprises adhesive disposed within said chamber, and wherein movement of said piston head ejects said adhesive from said chamber and through said apertures of said fastener plate to allow the formation of an adhesive bond between said plate and said substrate.

11. An assembly as recited in claim 10, wherein said adhesive is encapsulated in at least one capsule disposed in said chamber.

12. A drawer slide mounting apparatus, comprising:

(a) a drawer slide assembly, said slide assembly including a first member attachable to a drawer and a second member attachable to a cabinet, said first member slideably engaged with said second member such that the first member can slide with respect to the second member, said second member having a plurality of apertures; and (b) an alignment assembly connected to said second member of said drawer slide assembly over at least one aperture of said plurality of apertures, the alignment assembly including a cartridge body with an explosion chamber, an explosive charge in said explosion chamber, means for detonating said explosive charge, a piston head and at least one fastener disposed in said cartridge body.

13. An apparatus as recited in claim 12:

wherein said fastener comprises a shaft fixed to said piston head; and wherein said piston head is disposed between said explosive charge and said shaft.

14. An apparatus as recited in claim 13:

wherein said fastener further comprises an adhesive disposed about said shaft; and wherein said piston head is disposed between said explosive charge and said adhesive.

15. An apparatus as recited in claim 12, wherein said fastener comprises an adhesive; and wherein said piston head is disposed between said explosive charge and said adhesive.

16. A self-fastening drawer slide apparatus, comprising:

(a) a rail member;

(b) a track member, said track member slideably engaged with said rail member such that the rail member can slide with respect to the track member;

(c) a fastener plate coupled with said track member, said fastener plate having a plurality of apertures; and (d) a fastener assembly connected to said fastener plate over at least one of said apertures, the fastener assembly including a body with a detonation chamber, an explosive charge within said detonation chamber, means for detonating said explosive charge, a piston head, and at least one fastener within said body.

17. An apparatus as recited in claim 16:

wherein said fastener comprises an adhesive material; and wherein said piston head is disposed between said explosive charge and said adhesive.

18. An apparatus as recited in claim 16:

wherein said fastener comprises a pointed shaft securely fixed to said piston head; and wherein said piston head is disposed between said explosive charge and said shaft.

19. An apparatus as recited in claim 16:

wherein said fastener comprises encapsulated adhesive disposed about a pointed shaft coupled to said piston head; and wherein said piston head is disposed between said explosive charge and said shaft.

20. An apparatus as recited in claim 16, wherein said fastener plate further comprises means for permanently affixing said drawer slide apparatus to a cabinet.

21. An apparatus as recited in claim 20, wherein said means for permanently a said drawer slide apparatus to a cabinet comprises a plurality of pronged arms.

22. A mounting apparatus for sliding drawer hardware of the type having a track and rail, comprising:

(a) a bracket configured for attachment to a drawer hardware track; and (b) a cartridge coupled to said bracket, said cartridge having a body with an interior detonation chamber;

(c) an explosive charge disposed within said chamber;

(d) means for detonating said charge; and (e) a fastener disposed within said cartridge;

(f) said means for detonating said explosive charge comprising a lanyard coupled to a frictional detonator.

23. An apparatus as recited in claim 22, wherein said explosive charge is selected from the group consisting of fulminate of mercury, fulminate of silver, lead azide and silver azide.

24. An apparatus as recited in claim 22, wherein said fastener comprises a tack.

25. An apparatus as recited in claim 22, wherein said fastener comprises an adhesive material.

26. An apparatus as recited in claim 22, wherein said fastener comprises an adhesive material disposed about a shaft of a tack.

27. An apparatus as recited in claim 22, further comprising a support block, wherein said bracket is mounted to said block.

28. An apparatus for aligning sliding drawer hardware during installation in a cabinet or article of furniture, comprising:

(a) a fastener plate;

(b) a cartridge containing an explosive charge, said cartridge coupled to said fastener plate, said cartridge including a fastener; and (c) a detonation device coupled to said cartridge;

(d) wherein detonation of said explosive charge expels said fastener through said fastener plate and secures said fastener plate to a wall of said cabinet or article of furniture;

(e) wherein said fastener comprises an adhesive and a tack; and (f) wherein said tack has a head disposed between said explosive charge and said adhesive.

29. An alignment and mounting assembly, comprising:

(a) a fastener plate having a plurality of apertures; and (b) a fastener assembly mounted to the fastener plate, said fastener assembly having a body with a chamber positioned contiguously with an aperture of said plurality of apertures, a piston head, a fastener capable of fastening said fastener plate to a substrate, and means for moving the piston head wherein said fastener is capable of fastening said fastener plate to said substrate;

(c) wherein said means for moving said piston head comprises an explosive charge placed within said chamber;

(d) wherein said explosive charge includes means for igniting said charge; and (e) wherein said means for igniting said charge comprises a lanyard coupled to a frictional detonator.

30. An assembly as recited in claim 29, wherein said fastener plate further comprises means for permanently coupling said plate to said substrate.

31. An assembly as recited in claim 30, wherein said means for permanently affixing said fastener plate to said substrate comprises a plurality of arms, said arms having a plurality of tines.

32. An assembly as recited in claim 29, wherein said explosive charge is selected from the group consisting of fulminate of mercury, fulminate of silver, lead azide and silver azide.

33. An assembly as recited in claim 29, wherein said fastener comprises a shaft disposed on a shaft side of said piston head, wherein the shaft is driven out of said chamber by said means for moving said piston head.

34. An assembly as recited in claim 33, wherein said fastener further comprises adhesive disposed within said chamber on the shaft side of said piston head, and wherein the movement of said piston head ejects said adhesive from said chamber and through said apertures of said plate to allow the formation of an adhesive bond between said fastener plate and said substrate.

35. An assembly as recited in claim 34, wherein said adhesive is encapsulated in at least one capsule disposed in said chamber.

36. An assembly as recited in claim 29, wherein said fastener comprises adhesive disposed within said chamber, and wherein movement of said piston head ejects said adhesive from said chamber and through said apertures of said fastener plate to allow the formation of an adhesive bond between said plate and said substrate.

37. An assembly as recited in claim 36, wherein said adhesive is encapsulated in at least one capsule disposed in said chamber.

38. An alignment and mounting assembly, comprising:

(a) a fastener plate having a plurality of apertures; and (b) a fastener assembly mounted to the fastener plate, said fastener assembly having a body with a chamber positioned contiguously with an aperture of said plurality of apertures, a piston head, a fastener capable of fastening said plate to a substrate, and means for moving the piston head;

(c) wherein the fastener comprises adhesive disposed within said chamber, and wherein movement of said piston head ejects said adhesive from said chamber and through said apertures of said fastener plate to allow the formation of an adhesive bond between said plate and said substrate.

39. An assembly as recited in claim 38, wherein said fastener plate further comprises means for permanently coupling said plate to said substrate.

40. An assembly as recited in claim 39, wherein said means for permanently affixing said fastener plate comprises a plurality of arms, said arms having a plurality of tines.

41. An assembly as recited in claim 38, wherein said means for moving said piston head comprises an explosive charge placed within said chamber.

42. An assembly as recited in claim 41, wherein said explosive charge is selected from the group consisting of fulminate of mercury, fulminate of silver, lead azide and silver azide.

43. An assembly as recited in claim 41, wherein said explosive charge further includes means for igniting said charge.

44. An assembly as recited in claim 43, wherein said means for igniting said charge comprises a lanyard coupled to a frictional detonator.

45. An assembly as recited in claim 38, wherein said fastener further comprises a shaft disposed on a shaft side of said piston head, wherein the shaft is driven out of said chamber by said means for moving said piston head.

46. An assembly as recited in claim 38, wherein said adhesive is encapsulated in at least one capsule disposed in said chamber.

47. An assembly as recited in claim 38, wherein said adhesive is encapsulated in at least one capsule disposed in said chamber.

48. An alignment and mounting assembly, comprising:

(a) a fastener plate having a plurality of apertures;

(b) a fastener assembly mounted to the fastener plate, said fastener assembly having a body with a chamber positioned contiguously with an aperture of said plurality of apertures, a tack disposed within said chamber, said tack having a head and a shaft, said shaft disposed on a shaft side of said tack head, and means for moving said tack head wherein said shaft is driven out of said chamber and through said fastener plate; and (c) adhesive disposed within said chamber on the shaft side of said head of said tack, wherein movement of said tack head ejects said adhesive from said chamber and through said apertures of said fastener plate to allow the formation of an adhesive bond between said fastener plate and a substrate.

49. An assembly as recited in claim 48, wherein said fastener plate further comprises means for permanently coupling said plate to said substrate.

50. An assembly as recited in claim 49, wherein said means for permanently affixing said fastener plate comprises a plurality of arms, said arms having a plurality of tines.

51. An apparatus as recited in claim 48, wherein said means for moving said tack head comprises an explosive charge placed within said chamber.

52. An assembly as recited in claim 51, wherein said explosive charge is selected from the group consisting of fulminate of mercury, fulminate of silver, lead azide and silver azide.

53. An assembly as recited in claim 51, wherein said explosive charge further includes means for igniting said charge.

54. An assembly as recited in claim 53, wherein said means for igniting said charge comprises a lanyard coupled to a frictional detonator.

55. An assembly as recited in claim 48, wherein said adhesive is encapsulated in at least one capsule disposed in said chamber.

* * * * *